US010246925B2

(12) United States Patent
Vetter

(10) Patent No.: US 10,246,925 B2
(45) Date of Patent: Apr. 2, 2019

(54) ADJUSTABLE CASEMENT WINDOW SASH LIFTER

(71) Applicant: Truth Hardware Corporation, Owatonna, MN (US)

(72) Inventor: Gregory J Vetter, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 107 days.

(21) Appl. No.: 15/433,544

(22) Filed: Feb. 15, 2017

(65) Prior Publication Data

US 2017/0234049 A1 Aug. 17, 2017

Related U.S. Application Data

(60) Provisional application No. 62/295,464, filed on Feb. 15, 2016.

(51) Int. Cl.
*E05F 7/00* (2006.01)

(52) U.S. Cl.
CPC ..... *E05F 7/005* (2013.01); *E05Y 2900/148* (2013.01)

(58) Field of Classification Search
CPC .... E05F 7/06; E05F 7/04; E05F 7/005; Y10T 292/71
See application file for complete search history.

(56) References Cited

U.S. PATENT DOCUMENTS

| | | | | | |
|---|---|---|---|---|---|
| 2,453,049 | A * | 11/1948 | Triller | E05F 7/005 | 16/82 |
| 4,192,039 | A * | 3/1980 | Haberle | B60J 5/101 | 16/86 B |
| 4,790,107 | A * | 12/1988 | Cunningham | E05F 7/005 | 49/383 |
| 6,676,201 | B2 * | 1/2004 | Im | B60J 5/101 | 16/82 |
| 8,141,299 | B2 * | 3/2012 | Vetter | E05F 7/005 | 16/86 B |
| 8,322,762 | B2 * | 12/2012 | Watson | E05F 7/005 | 292/342 |
| 2007/0289219 | A1 * | 12/2007 | Heid | E05F 7/005 | 49/395 |
| 2008/0168715 | A1 * | 7/2008 | Titus | E05F 7/06 | 49/353 |
| 2010/0043299 | A1 * | 2/2010 | Vetter | E05F 7/005 | 49/401 |
| 2010/0219648 | A1 * | 9/2010 | Watson | E05F 7/005 | 292/343 |

FOREIGN PATENT DOCUMENTS

| | | | |
|---|---|---|---|
| CN | 201581736 | * | 9/2010 |
| DE | 102010000812 | * | 7/2011 |
| GB | 2142681 | * | 7/1985 |

* cited by examiner

*Primary Examiner* — Justin B Rephann
(74) *Attorney, Agent, or Firm* — Patterson Thuente Pedersen, P.A.

(57) ABSTRACT

A sash lifter assembly for a casement to equalize the amount of reveal at the top and bottom of the casement window sash, and that is also adjustable to accommodate manufacturing tolerances. The sash lifter raises the entire sash up to equalize the reveal at the top and bottom of the window. It is adjustable to accommodate the variation in reveal due to manufacturing tolerances.

12 Claims, 12 Drawing Sheets

ADJUSTABLE CASEMENT WINDOW SASH LIFTER

RELATED APPLICATION

The present application claims the benefit of U.S. Provisional Application No. 62/295,464, filed Feb. 15, 2016, which is hereby incorporated herein in its entirety by reference.

TECHNICAL FIELD

The present invention relates to casement windows, and more specifically to sash adjustments in casement windows.

BACKGROUND

When casement windows are made, there are manufacturing tolerances to the heights of the sash and frame. This can cause the vertical space between the sash and frame (the reveal) to vary by over ⅛ inch. When concealed casement hinges are used, the bottom hinge supports all the sash weight, so the distance between the bottom of the sash and frame is a fixed dimension (the hinge height) and all the variation in sash & frame height shows up as extra clearance between the top of the sash and frame. The extra clearance can be large enough to cause gaps between the upper weatherstripping and its sealing surface and result in leaks. Additionally, a reveal at the top of the sash that is twice as large as at the bottom can cause aesthetic issues and a perception of poor quality.

Sash lifters have been developed to address this problem. One such prior design is disclosed in U.S. Patent Application Publication No. US2008/0168715 A1, said document being hereby fully incorporated herein by reference. Such older designs, however, merely support the bottom of the sash in an attempt to make the bottom reveal a uniform height across the width of the sash (bottom of sash parallel to frame). They are not just adjustable in height. And, as depicted in FIG. 2, because the lifter 100 is located a relatively large distance X from the center of rotation C of the sash 102, it causes a relatively large addition to operating torque as the sash rides up the ramp of the lifter 100.

What is needed in the industry is a sash lifter to equalize the amount of reveal at the top and bottom of a casement window sash, and that is also adjustable to accommodate manufacturing tolerances.

SUMMARY

Embodiments of the invention address the need in the industry for a sash lifter to equalize the amount of reveal at the top and bottom of a casement window sash, and that is also adjustable to accommodate manufacturing tolerances. The sash lifter raises the entire sash up to equalize the reveal at the top and bottom of the window. It is adjustable to accommodate the variation in reveal due to manufacturing tolerances. It effects only a minor addition to operating torque.

In embodiments, an adjustable sash lifter assembly for a casement window includes a first sash lifter adapted to attach to the frame or the sash of the casement window. The first sash lifter has a mounting portion and a lifting portion selectively engagable with the mounting portion, the lifting portion having an end presenting a lifting ramp, the lifting portion being selectively vertically shiftable relative to the mounting portion. The assembly further includes a second sash lifter adapted to attach to the other of the frame or the sash of the casement window, the second sash lifter having an end presenting a lifting ramp. When the casement window is shifted from the open position to the closed position, the ramp of the first sash lifter engages with the ramp of the second sash lifter, causing the sash to shift vertically relative to the frame.

In embodiments, the mounting portion of the first sash lifter presents a plurality of teeth, and the lifting portion presents a corresponding plurality of teeth engagable with the teeth of the mounting portion in a plurality of positions such that the lifting portion is selectively vertically shiftable relative to the mounting portion. The mounting portion may have at least one projecting rib, the teeth of the mounting portion being defined on opposing sides of the at least one projecting rib. The lifting portion can define a cavity having opposing walls each defining at least one inwardly projecting rib, the teeth of the lifting portion projecting into the cavity from each inwardly projecting rib.

In other embodiments, the mounting portion of the first sash lifter includes an adjustment screw, wherein the vertical position of the lifting portion is selectively shiftable relative to the mounting portion with the adjustment screw.

In embodiments, the second sash lifter includes a mounting portion and a lifting portion selectively engagable with the mounting portion, the lifting portion having an end presenting a lifting ramp, the lifting portion being selectively vertically shiftable relative to the mounting portion. The mounting portion of the second sash lifter can present a plurality of teeth, and the lifting portion of the second sash lifter can present a corresponding plurality of teeth engagable with the teeth of the mounting portion of the second sash lifter in a plurality of positions such that the lifting portion of the second sash lifter is selectively vertically shiftable relative to the mounting portion of the second sash lifter. The mounting portion of the second sash lifter may have at least one projecting rib, the teeth of the mounting portion of the second sash lifter being defined on opposing sides of the at least one projecting rib. The lifting portion of the second sash lifter may define a cavity having opposing walls, each defining at least one inwardly projecting rib, the teeth of the lifting portion of the second sash lifter projecting into the cavity from each inwardly projecting rib.

In further embodiments, the mounting portion of the second sash lifter can include an adjustment screw, wherein the vertical position of the lifting portion of the second sash lifter is selectively shiftable relative to the mounting portion with the adjustment screw.

In embodiments, a casement window includes a frame defining an opening, a sash hinged to the frame such that the sash shiftable between an open position in which the sash is clear from the opening and a closed position in which the sash closes the opening, and a sash lifter assembly. The sash lifter assembly includes a first sash lifter attached to a hinge side of the frame or the hinge side of the sash of the casement window, the first sash lifter including a mounting portion and a lifting portion selectively engagable with the mounting portion, the lifting portion having an end presenting a lifting ramp, the lifting portion being selectively vertically shiftable relative to the mounting portion, and a second sash lifter adapted to attach to the other of the frame or the sash of the casement window, the second sash lifter having an end presenting a lifting ramp. When the casement window is shifted from the open position to the closed position, the ramp of the first sash lifter engages with the ramp of the second sash lifter, causing the sash to shift vertically relative to the frame.

In embodiments of the casement window, the mounting portion of the first sash lifter presents a plurality of teeth, and the lifting portion presents a corresponding plurality of teeth engagable with the teeth of the mounting portion in a plurality of positions such that the lifting portion is selectively vertically shiftable relative to the mounting portion. The mounting portion may have at least one projecting rib, the teeth of the mounting portion being defined on opposing sides of the at least one projecting rib. The lifting portion defines a cavity having opposing walls each defining at least one inwardly projecting rib, the teeth of the lifting portion projecting into the cavity from each inwardly projecting rib. In other embodiments, the mounting portion of the first sash lifter includes an adjustment screw, and the vertical position of the lifting portion is selectively shiftable relative to the mounting portion with the adjustment screw.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
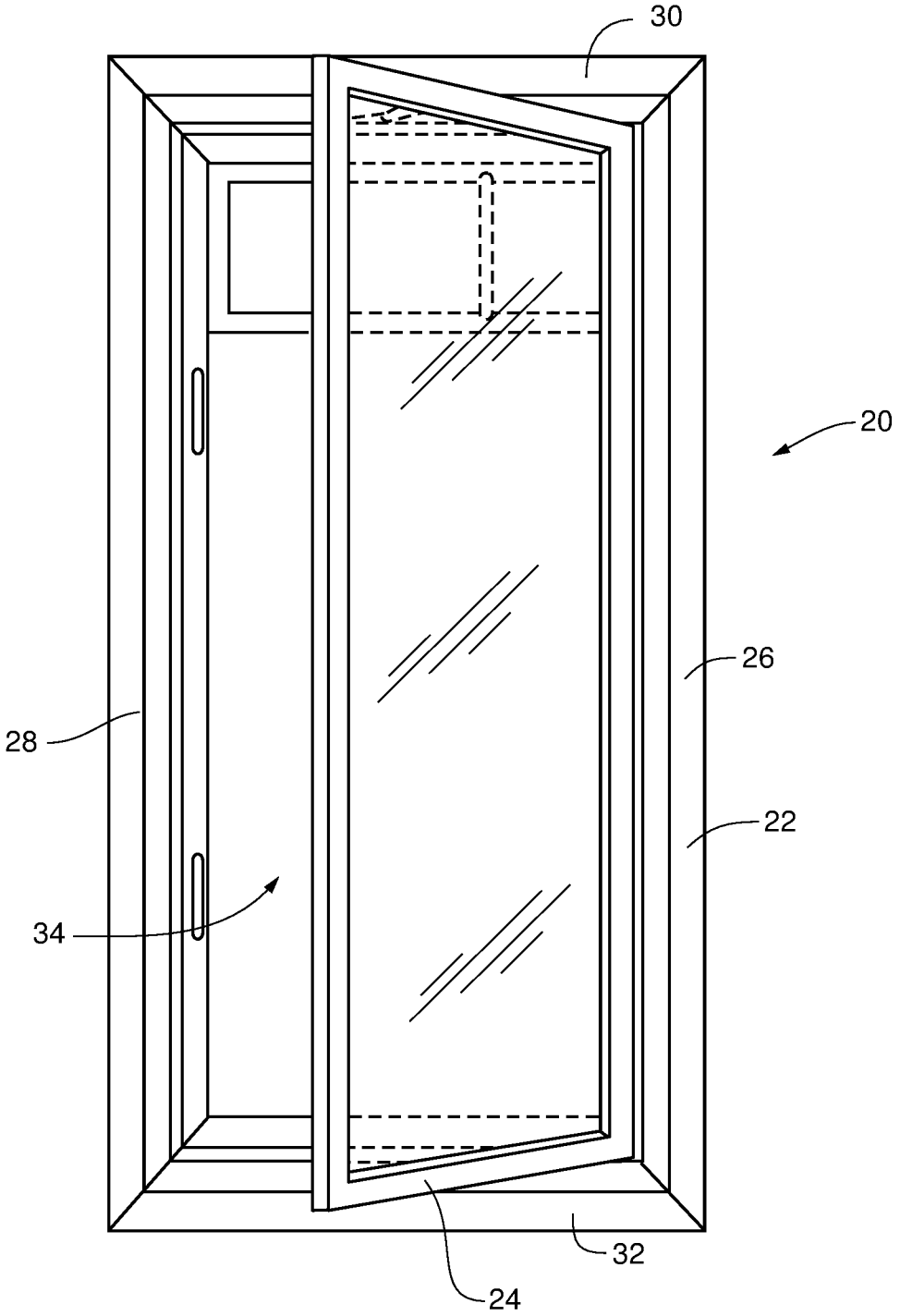
FIG. 1 depicts a casement window with an adjustable sash lifter according to an embodiment of the invention.
Figure 2:
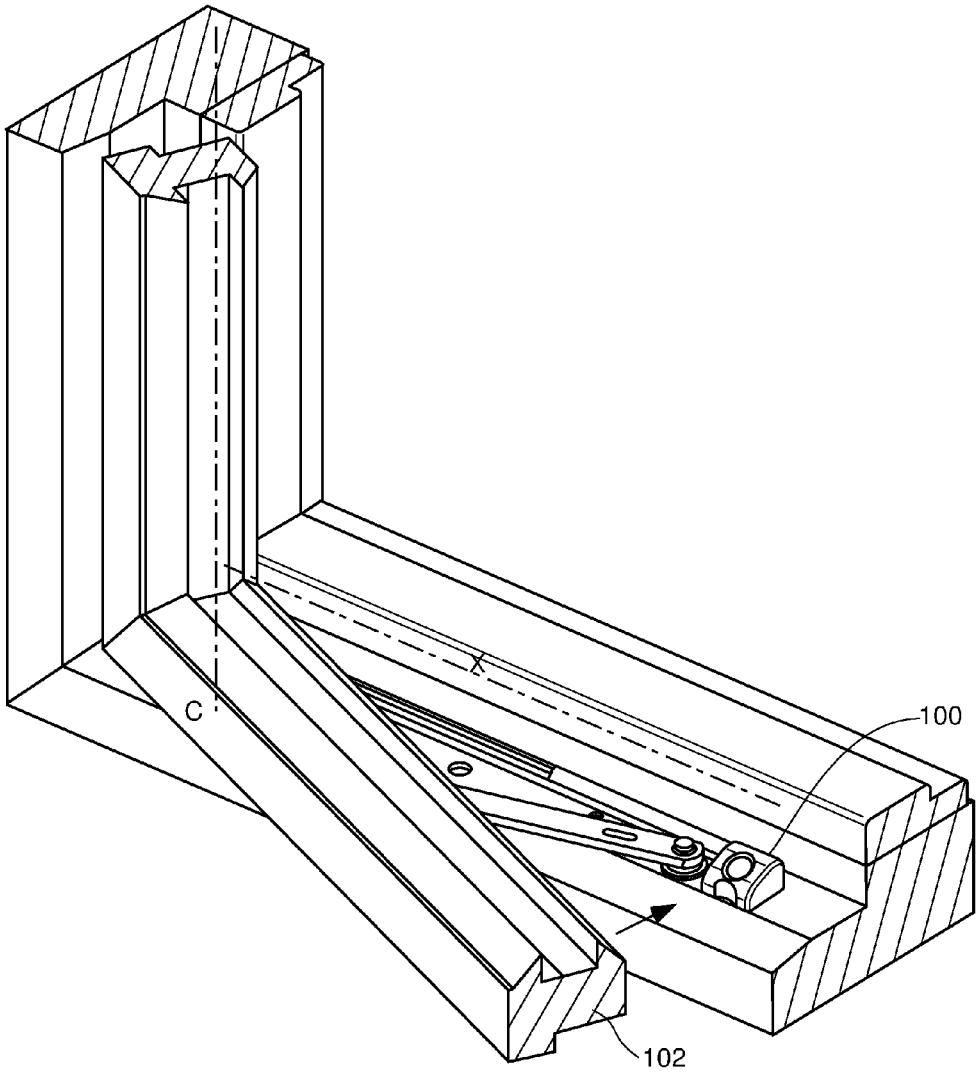
FIG. 2 depicts a prior art sash lifter and hinge.
Figure 3:
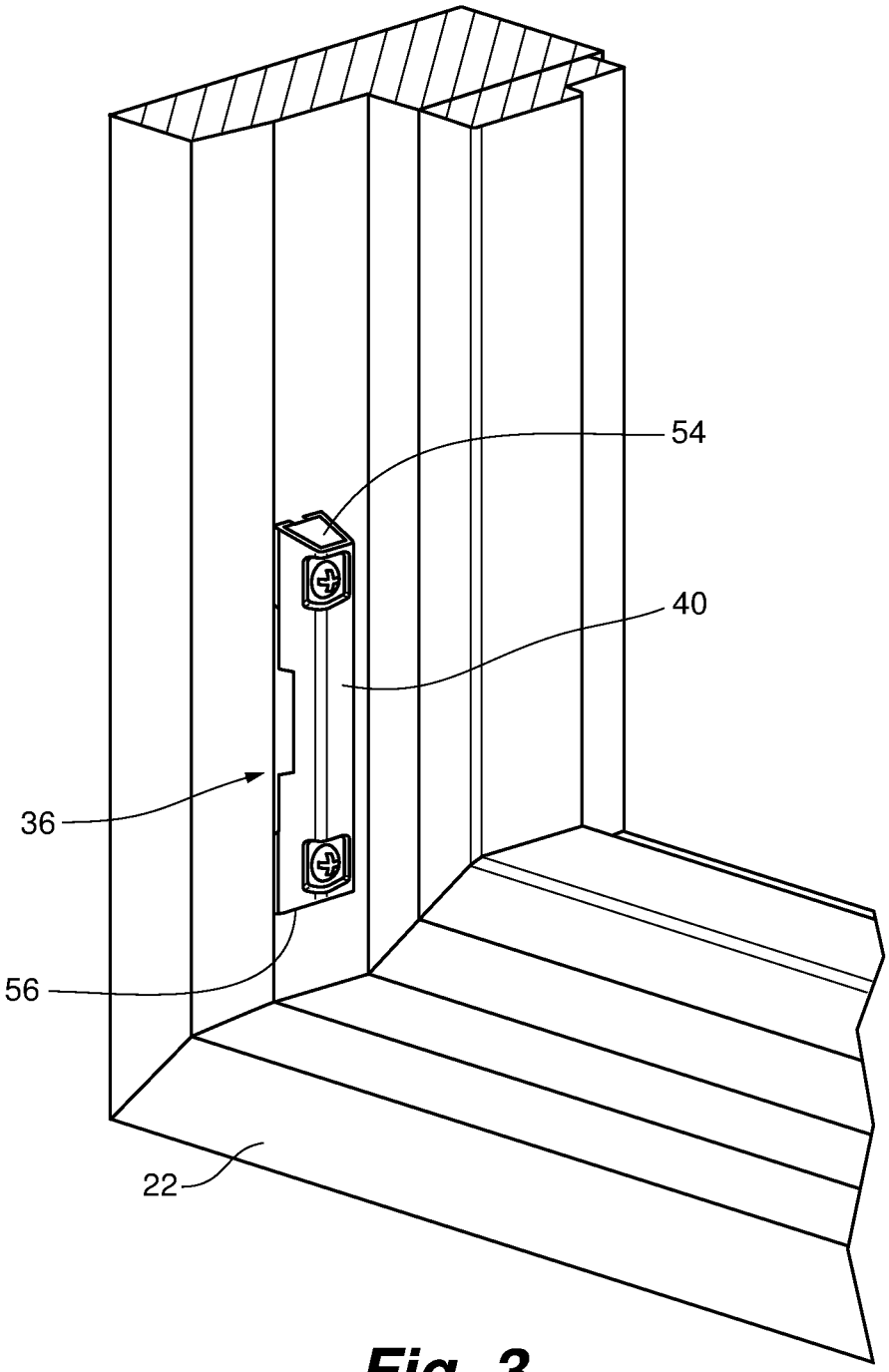
FIG. 3 depicts the frame portion of an adjustable sash lifter according to an embodiment of the invention, mounted on the window frame.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Figure 8:
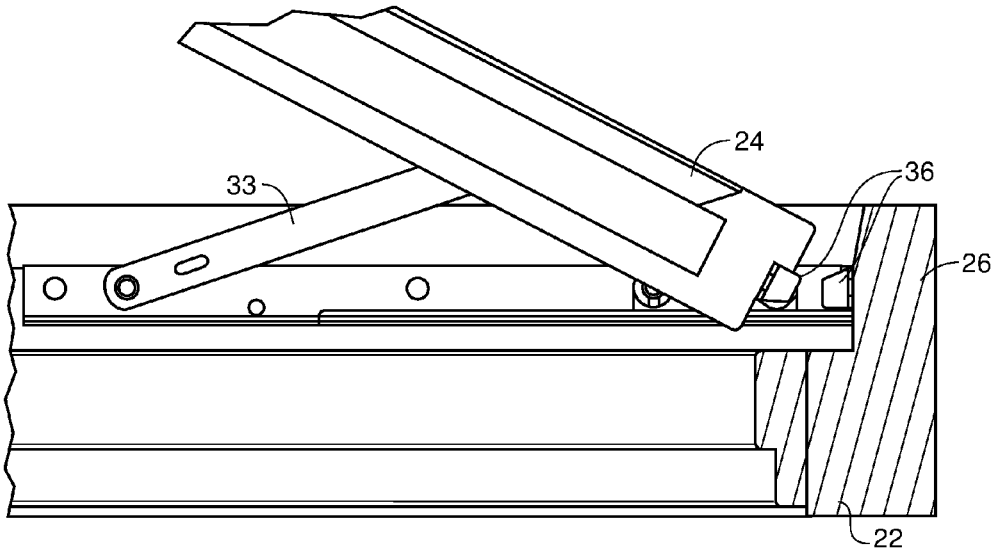
FIG. 8 is a top sectional view of the casement window and adjustable sash lifter of FIG. 7 with the sash in an opened position.

In FIG. 1, there is depicted a casement window 20 with adjustable sash lifter according to an embodiment of the invention. Casement window 20 generally includes frame 22 and sash 24. Frame 22 generally includes hinge side jamb 26, lock side jamb 28, top jamb 30, and bottom jamb 32, defining opening 34. As depicted in FIG. 8, sash 24 is hinged to frame 22 with hinges 33 attached to top jamb 30 and bottom jamb 32. A locking mechanism 34 may be provided in lock side jamb 28 to enable sash 24 to be locked in place when closed.

An adjustable sash lifter 36 according to an embodiment of the invention is depicted in FIGS. 3-10. Adjustable sash lifter 36 generally includes mounting portion 38 and lifting portion 40. Mounting portion 38 generally includes base plate 42 with central portion 44, and projecting ribs 46, 48. Each of ribs 46, 48, defines a multiplicity of teeth 50 on opposing faces. Aperture 52 is defined in central portion 44.

Lifting portion 40 is elongate with ramps 54, 56, at opposing ends. Cavity 58 is defined in rear side 60. Inwardly projecting ribs 62 are defined in cavity 58, each bearing a plurality of teeth 64. Apertures 66 are defined proximate the opposing ends of lifting portion 40.

Mounting portion 38 is received in cavity 58 of lifting portion 40, with teeth 50 meshed with teeth 64 so as to couple lifting portion 40 to mounting portion 38. It will be appreciated that teeth 64 can be engaged at various locations along length L of ribs 46, 48, thereby enabling lifting portion 40 to be shifted vertically in various positions relative to mounting portion 38.

Figure 9:
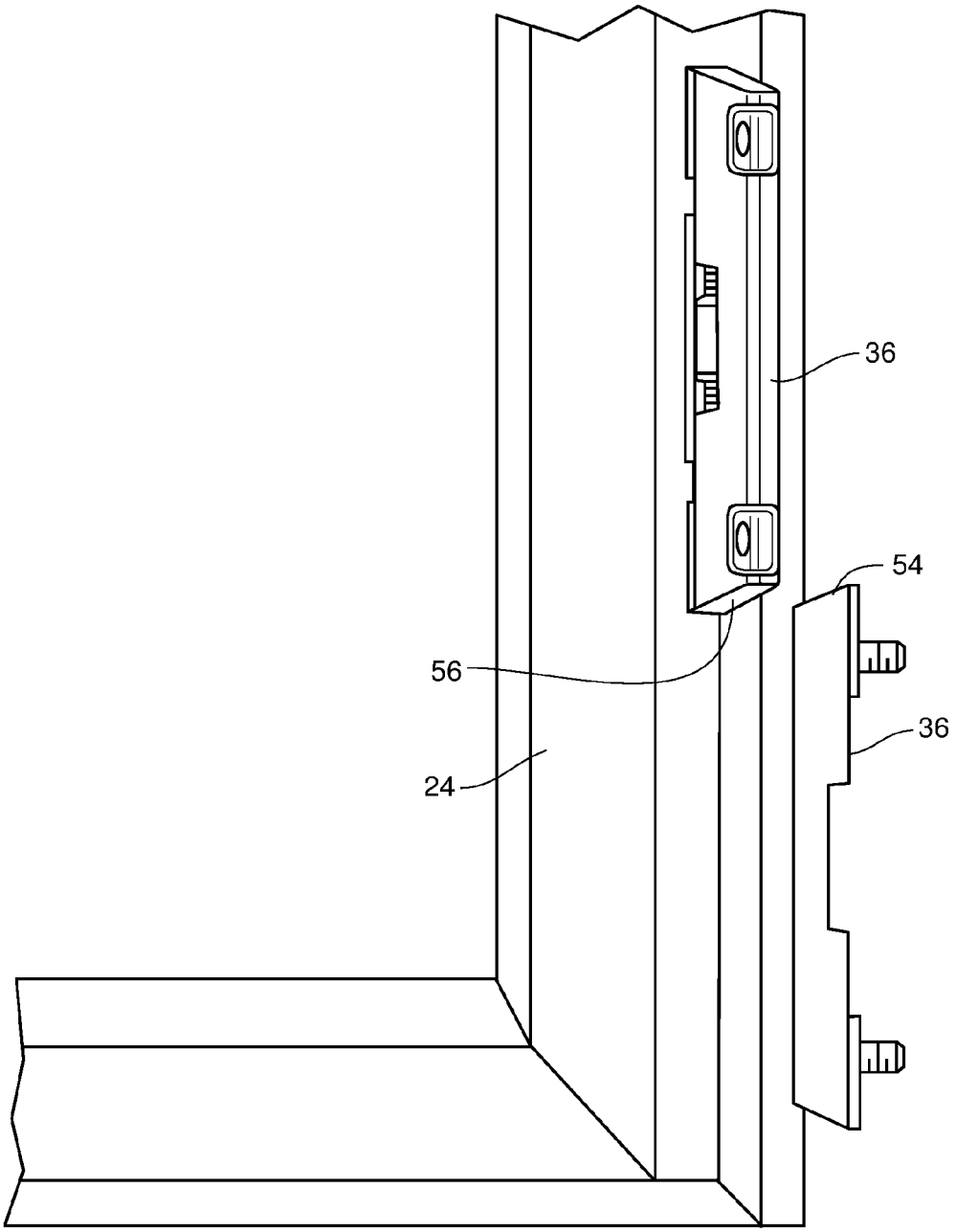
FIG. 9 is an isometric view of a casement window and adjustable sash lifter according to an embodiment of the invention, with the sash in an opened position and the frame not depicted for clarity.
Figure 10:
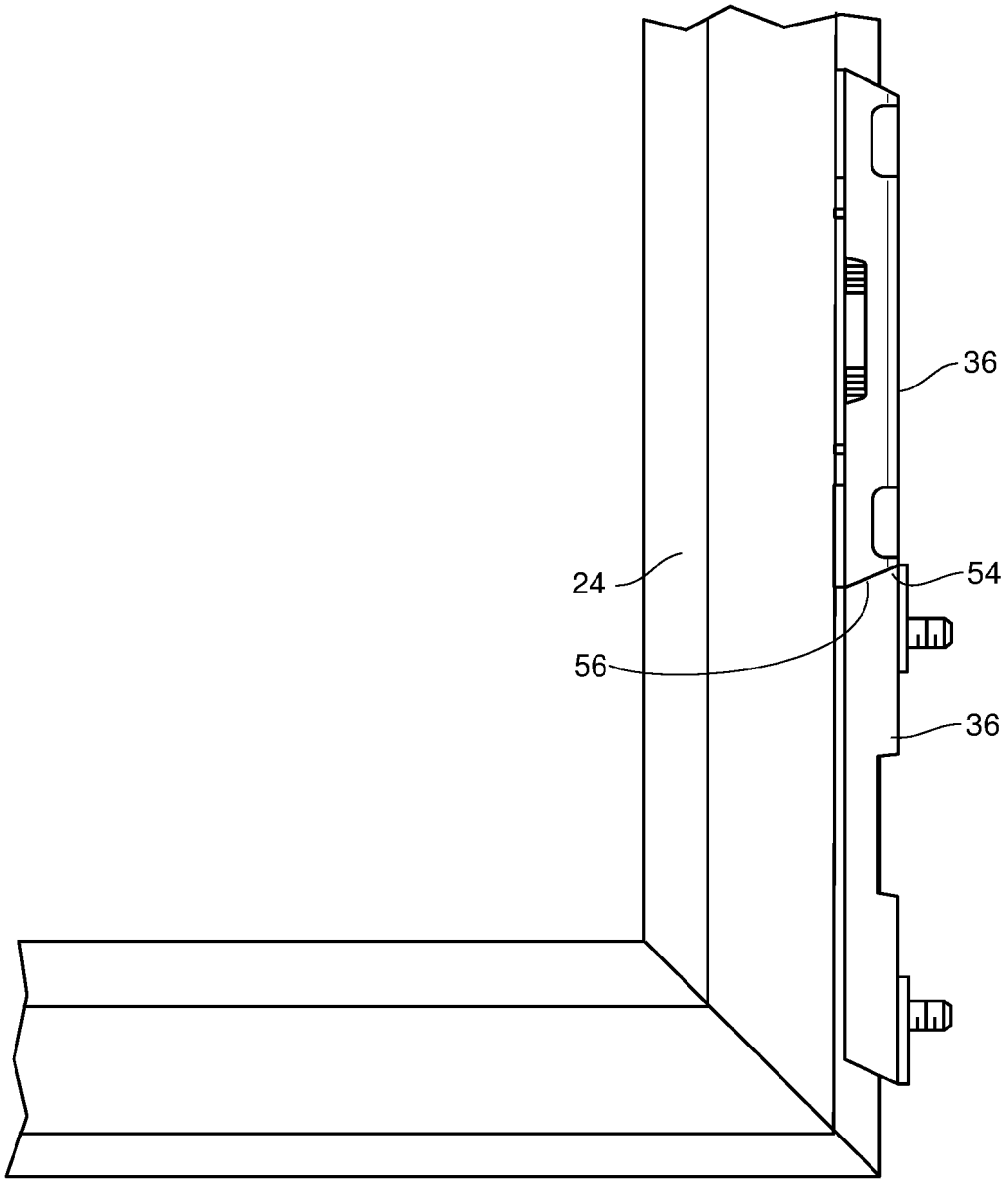
FIG. 10 is an isometric view of the casement window and adjustable sash lifter according to FIG. 9, with the sash in a closed position and the frame not depicted for clarity.

In use, one adjustable sash lifter 36 is mounted on sash 24 and another adjustable sash lifter 36 is mounted on hinge side rail 26 of frame 22 such that ramp 56 of sash lifter 36 mounted on sash 24 contacts and rides up on ramp 54 of sash lifter 36 mounted on frame 22 when sash 24 is closed, as depicted in FIGS. 9 and 10. As ramp 56 rides up on ramp 54, sash 24 is lifted relative to frame 22.

Figure 4:
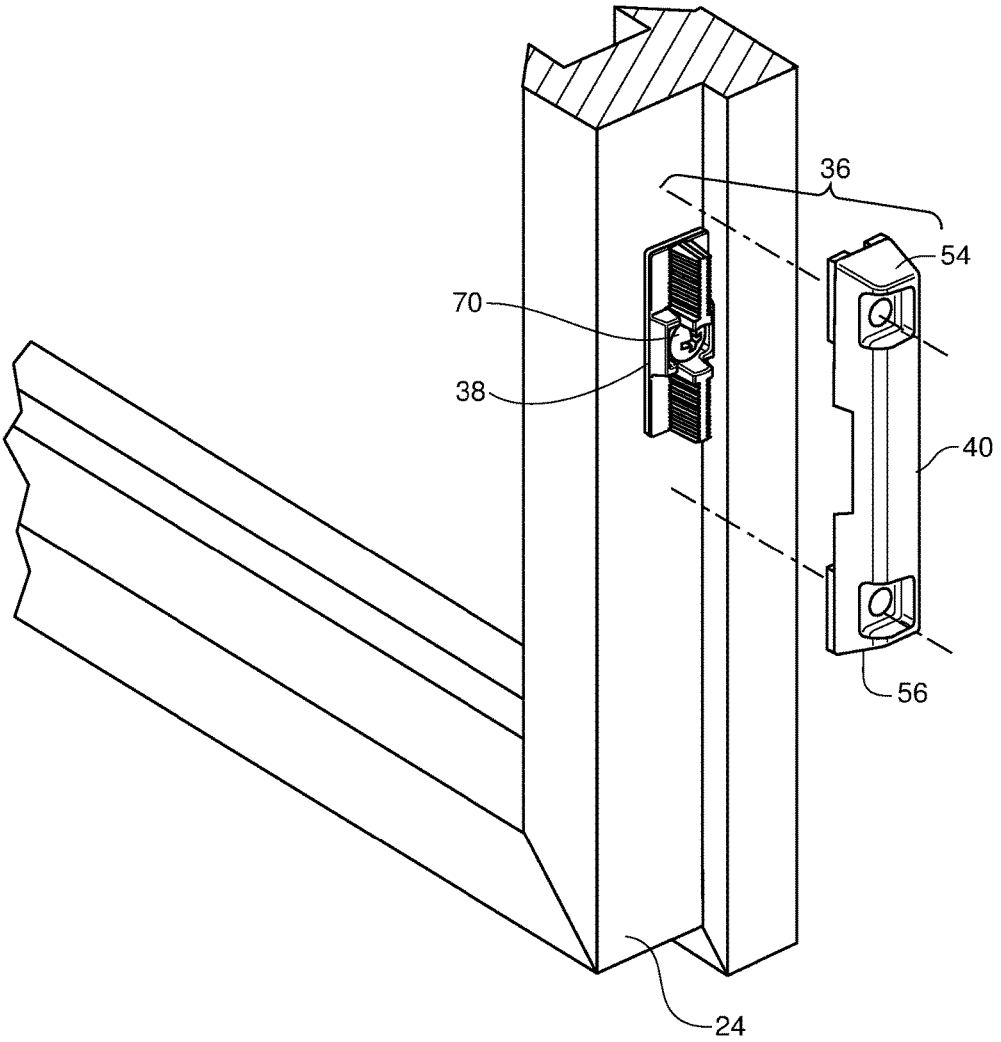
FIG. 4 depicts the sash portion of an adjustable sash lifter according to the embodiment of FIG. 3, mounted on the window sash.
Figure 5:
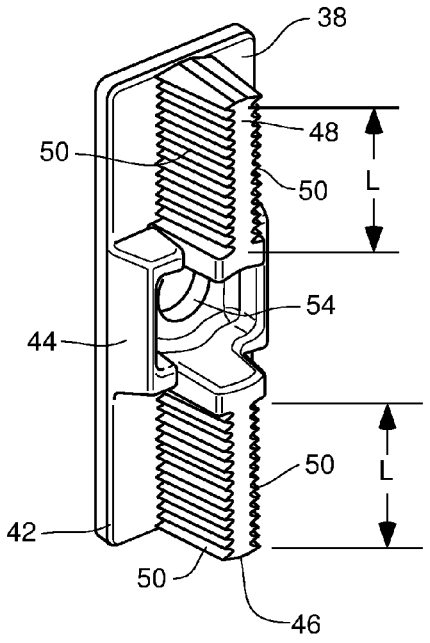
FIG. 5 is a front isometric view of a mounting portion of the adjustable sash lifter of FIGS. 3 and 4.
Figure 6:
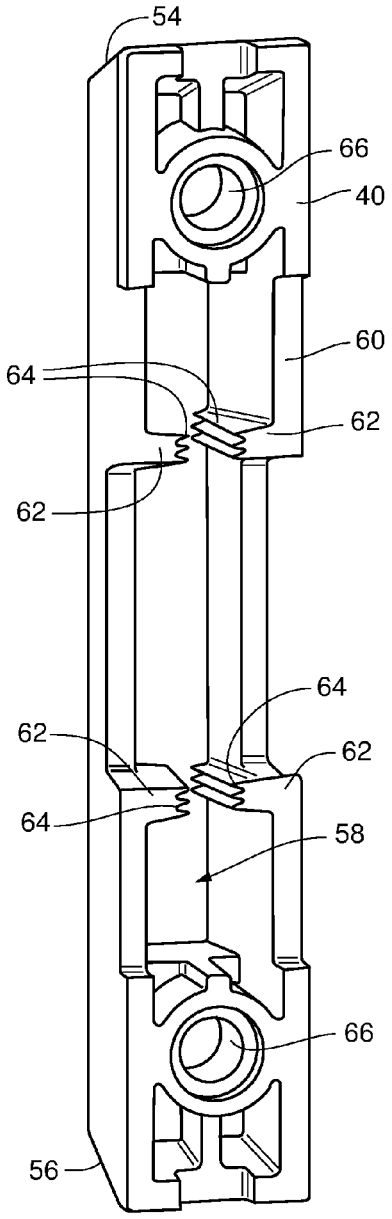
FIG. 6 is a rear isometric view of a lifting portion of the adjustable sash lifter of FIGS. 3 and 4.
Figure 7:
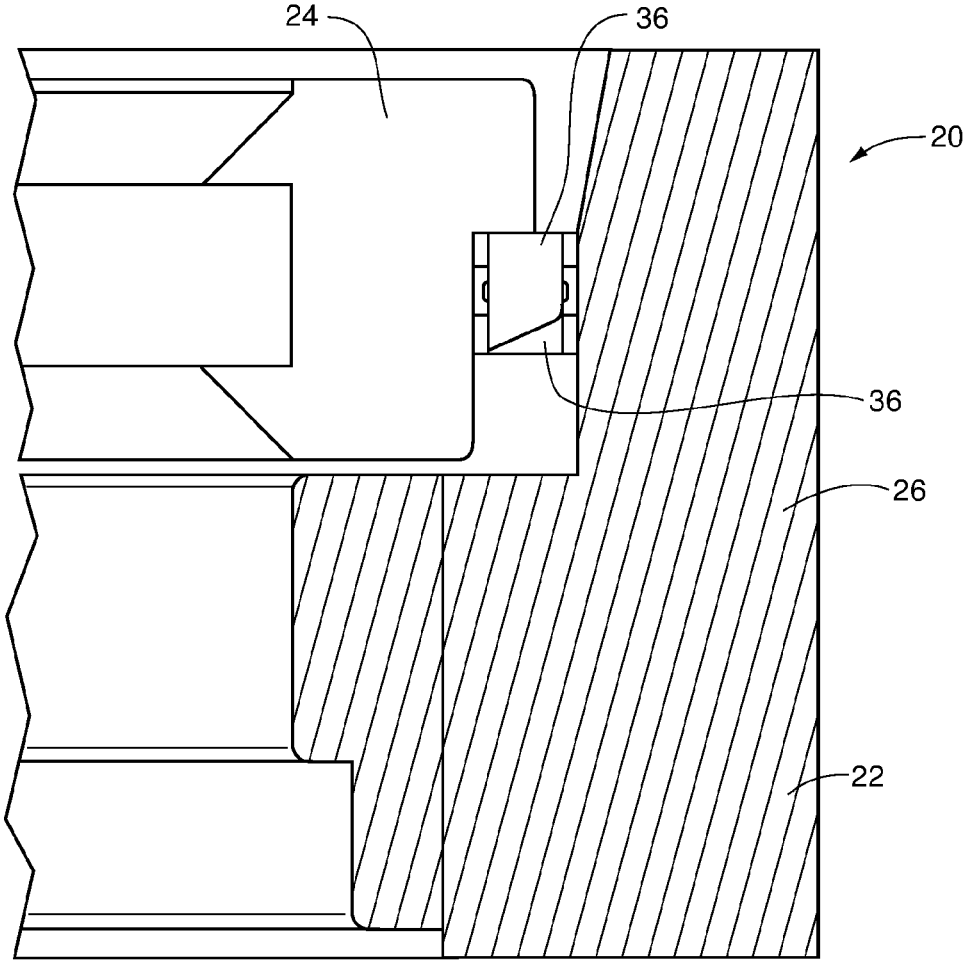
FIG. 7 is a top sectional view of a casement window with an adjustable sash lifter according to an embodiment of the invention, with the sash in a closed position.

Each adjustable sash lifter 36 is mounted to frame 22 or sash 24 by first attaching mounting portion 38 with a fastener 70 through aperture 54. Lifting portion 40 is then engaged over mounting portion 38 as depicted in FIG. 4. Again, it will be appreciated that the vertical position of each lifting portion 40 can be shifted by engaging teeth 64 at different points along ribs 46, 48, thereby enabling the degree of sash lift provided by the engagement of ramps 54, 56, to be adjusted. Once lifting portions 40 are positioned as desired, they can be fixed in position with fasteners through apertures 66.

Figure 11:
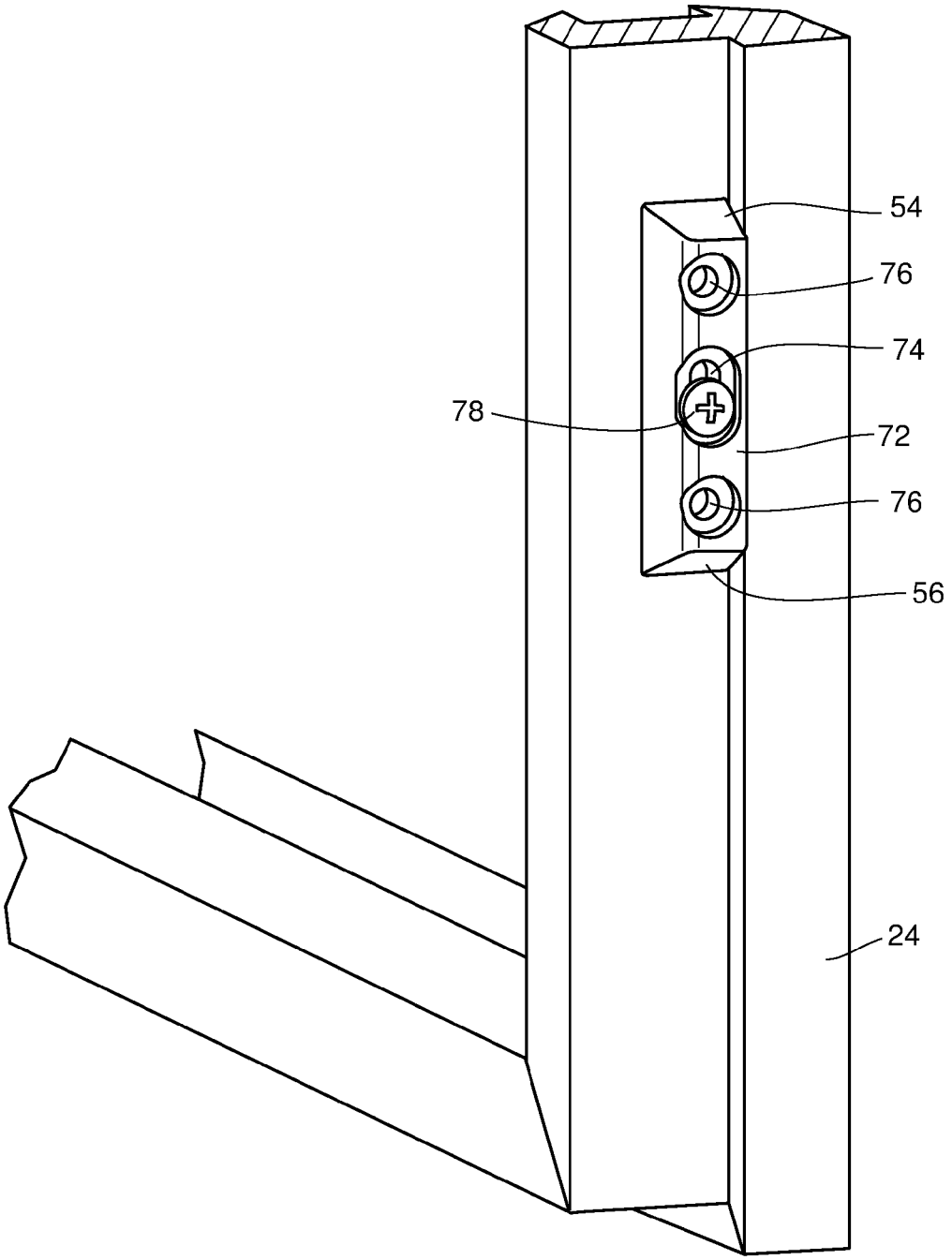
FIG. 11 is an isometric view of an adjustable sash lifter according to an alternative embodiment of the invention mounted on the sash of a casement window.

In the alternative embodiment of FIG. 11, adjustable sash lifter 72 is one piece, having a central slotted aperture 74, and two anchor apertures 76. As before, one adjustable sash lifter 72 is mounted on sash 24 and another adjustable sash lifter 72 is mounted on hinge side rail 26 of frame 22 such that ramp 56 of sash lifter 72 mounted on sash 24 contacts and rides up on ramp 54 of sash lifter 72 mounted on frame 22 when sash 24 is closed. Each sash lifter 72 is initially mounted to sash 24 or frame 22 with a fastener 78 through slotted aperture 74. Sash lifter 72 can be vertically positioned due to the ability of fastener 78 to slide within aperture 74. Once the sash lifter is in the desired position, fasteners can be driven through anchor apertures 76 to fix the sash lifter in position.

Figure 12:
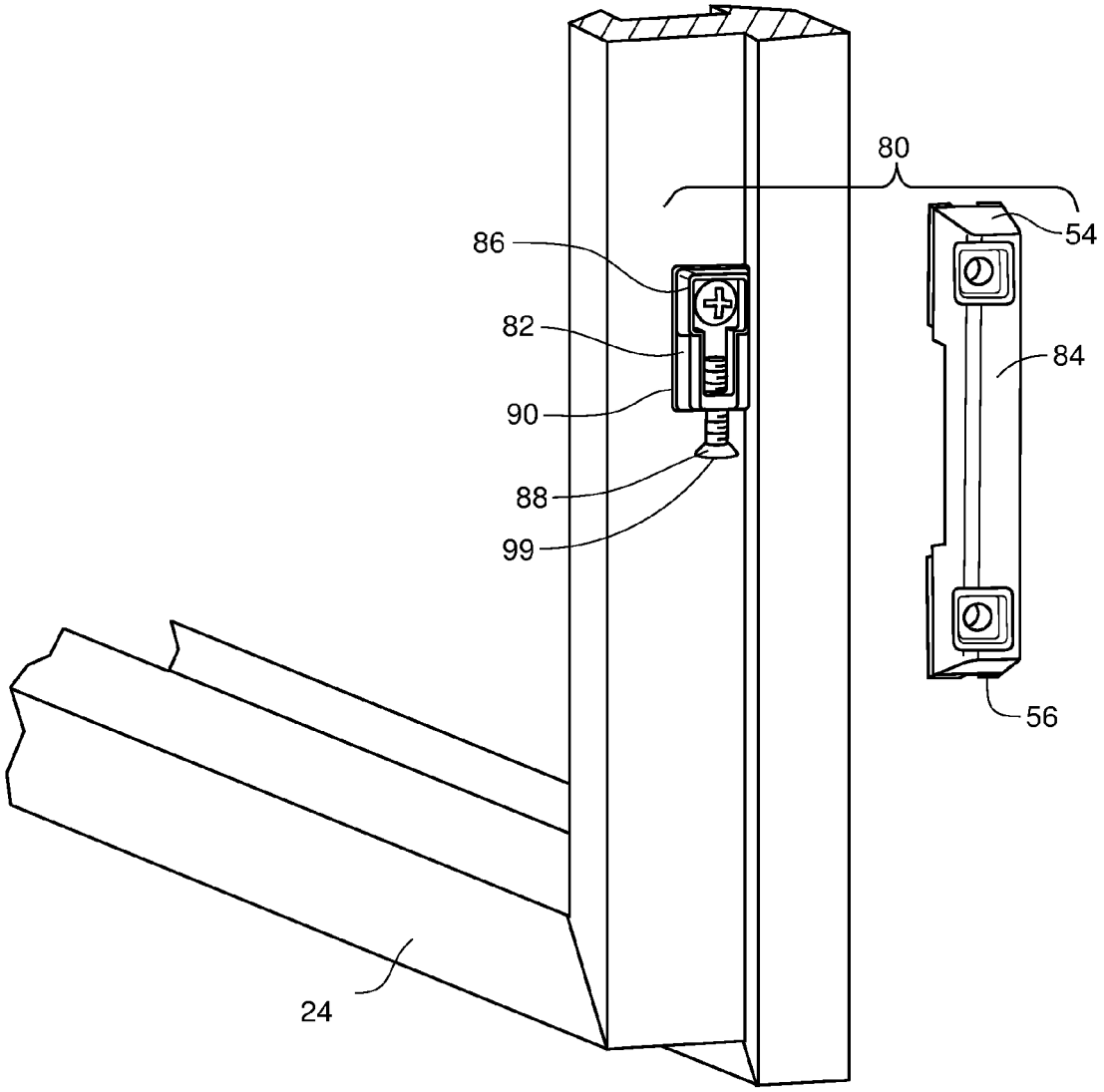
FIG. 12 is an exploded view of an adjustable sash lifter according to another alternative embodiment of the invention mounted on the sash of a casement window.
Figure 13:
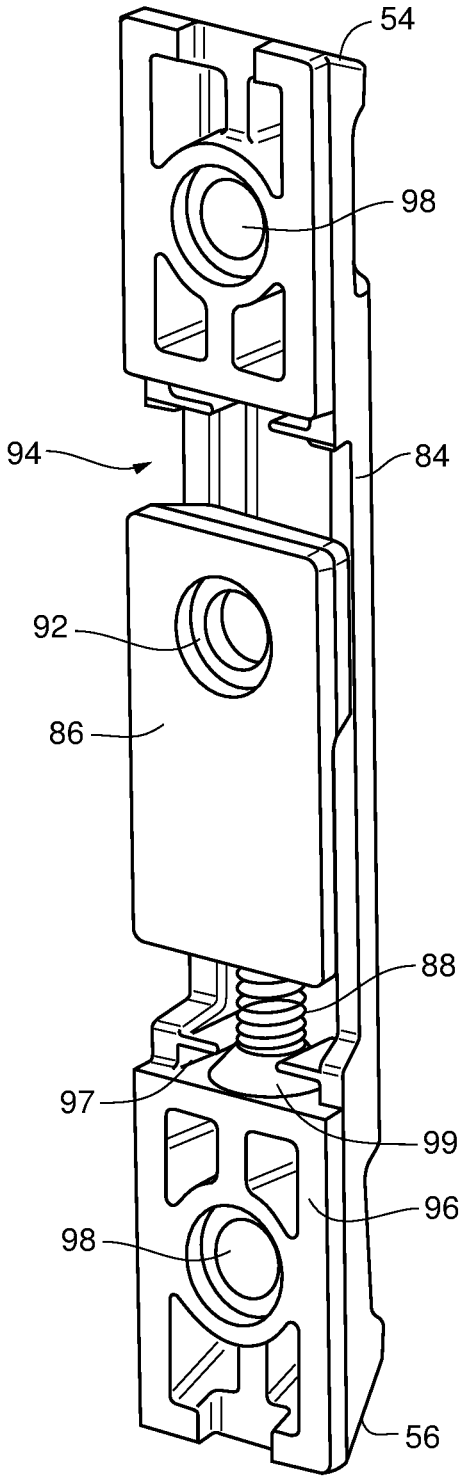
FIG. 13 is a rear isometric view of the adjustable sash lifter of FIG. 12.

Another alternative embodiment of an adjustable sash lifter 80 is depicted in FIGS. 12 and 13. Adjustable sash lifter 80 generally includes mounting portion 82 and lifting portion 84. Mounting portion 82 has mounting plate 86, adjustment screw 88, and screw receiver 90. Adjustment screw 88 can be threaded in and out of screw receiver 90, Mounting plate 86 defines aperture 92.

Lifting portion 84 is elongate with ramps 54, 56, at opposing ends. Recess 94 is defined in rear side 96. Receiving slot 97 is defined at one end of recess 94. Apertures 98 are defined proximate the opposing ends of lifting portion 84.

Lifting portion 84 is received on mounting portion 82, with screw head 99 received in receiving slot 97 to couple lifting portion 84 to mounting portion 82. It will be appreciated that lifting portion 84 can be shifted vertically in various positions relative to mounting portion 82 by threading screw 88 in or out of screw receiver 90 prior to engaging lifting portion 84.

Again, one adjustable sash lifter 80 is mounted on sash 24 and another adjustable sash lifter 80 is mounted on hinge side rail 26 of frame 22 such that ramp 56 of sash lifter 80 mounted on sash 24 contacts and rides up on ramp 54 of sash lifter 80 mounted on frame 22 when sash 24 is closed. As ramp 56 rides up on ramp 54, sash 24 is lifted relative to frame 22.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An adjustable sash lifter assembly for a casement window having a frame defining an opening and a sash hinged to the frame, the sash shiftable between an open position in which the sash is clear from the opening and a closed position in which the sash closes the opening, the sash lifter assembly, comprising:

a first sash lifter adapted to attach to the frame or the sash of the casement window, the first sash lifter comprising a mounting portion and a lifting portion selectively engagable with the mounting portion, the lifting portion having an end presenting a lifting ramp, the lifting portion being selectively vertically shiftable relative to the mounting portion, wherein the mounting portion of the first sash lifter presents a plurality of teeth, and the lifting portion presents a corresponding plurality of teeth engagable with the teeth of the mounting portion in a plurality of positions such that the lifting portion is selectively vertically shiftable relative to the mounting portion; and a second sash lifter adapted to attach to the other of the frame or the sash of the casement window, the second sash lifter having an end presenting a lifting ramp;

wherein when the casement window is shifted from the open position to the closed position, the ramp of the first sash lifter engages with the ramp of the second sash lifter, causing the sash to shift vertically relative to the frame.

2. The adjustable sash lifter assembly of claim 1, wherein the mounting portion has at least one projecting rib, the teeth of the mounting portion being defined on opposing sides of the at least one projecting rib.

3. The adjustable sash lifter assembly of claim 2, wherein the lifting portion defines a cavity having opposing walls each defining at least one inwardly projecting rib, the teeth of the lifting portion projecting into the cavity from each inwardly projecting rib.

4. The adjustable sash lifter assembly of claim 1, wherein the mounting portion of the second sash lifter presents a plurality of teeth, and the lifting portion of the second sash lifter presents a corresponding plurality of teeth engagable with the teeth of the mounting portion of the second sash lifter in a plurality of positions such that the lifting portion of the second sash lifter is selectively vertically shiftable relative to the mounting portion of the second sash lifter.

5. The adjustable sash lifter assembly of claim 4, wherein the mounting portion of the second sash lifter has at least one projecting rib, the teeth of the mounting portion of the second sash lifter being defined on opposing sides of the at least one projecting rib.

6. The adjustable sash lifter assembly of claim 5, wherein the lifting portion of the second sash lifter defines a cavity having opposing walls, each defining at least one inwardly projecting rib, the teeth of the lifting portion of the second sash lifter projecting into the cavity from each inwardly projecting rib.

7. The adjustable sash lifter assembly of claim 4, wherein the mounting portion of the second sash lifter includes an adjustment screw, and wherein a vertical position of the lifting portion of the second sash lifter is selectively shiftable relative to the mounting portion with the adjustment screw.

8. A casement window comprising:

a frame defining an opening;

a sash hinged to the frame, the sash shiftable between an open position in which the sash is clear from the opening and a closed position in which the sash closes the opening; and a sash lifter assembly, comprising:

a first sash lifter attached to a hinge side of the frame or a hinge side of the sash of the casement window, the first sash lifter comprising a mounting portion and a lifting portion selectively engagable with the mounting portion, the lifting portion having an end presenting a lifting ramp, the lifting portion being selectively vertically shiftable relative to the mounting portions, wherein the mounting portion of the first sash lifter presents a plurality of teeth, and the lifting portion presents a corresponding plurality of teeth engagable with the teeth of the mounting portion in a plurality t positions such that the lifting portion is selectively vertically shiftable relative to mounting portion; and a second sash lifter adapted to attach to the other of the frame or the sash of the casement window, the second sash lifter having an end presenting a lifting ramp;

wherein when the casement window is shifted from the open position to the closed position, the ramp of the first sash lifter engages with the ramp of the second sash lifter, causing the sash to shift vertically relative to the frame.

9. The casement window of claim 8, wherein the mounting portion has at least one projecting rib, the teeth of the mounting portion being defined on opposing sides of the at least one projecting rib.

10. The casement window of claim 9, wherein the lifting portion defines a cavity having opposing walls each defining at least one inwardly projecting rib, the teeth of the lifting portion projecting into the cavity from each inwardly projecting rib.

11. An adjustable sash lifter assembly for a casement window having a frame defining an opening and a sash hinged to the frame, the sash shiftable between an open position in which the sash is clear from the opening and a closed position in which the sash closes the opening, the sash lifter assembly, comprising:

a first sash lifter adapted to attach to the frame or the sash of the casement window, the first sash lifter comprising a mounting portion and a lifting portion selectively engagable with the mounting portion, the lifting portion having an end presenting a lifting ramp, the lifting portion being selectively shiftable relative to the mounting portion; and a second sash lifter adapted to attach to the other of the frame or the sash of the casement window, the second sash lifter having an end presenting a lifting ramp;

wherein when the casement window is shifted from the open position to the closed position, the ramp of the first sash lifter engages with the ramp of the second sash lifter, causing the sash to shift vertically relative to the frame, and wherein the mounting portion of the first sash lifter includes an adjustment screw arranged to drive vertical shifting of a vertical position of the lifting portion.

12. A casement window comprising:

a frame defining an or opening:

a sash hinged to the frame, the sash shiftable between an open position in which the sash is clear from the opening and a closed position in which the sash closes the opening; and a sash lifter assembly, comprising:

a first sash lifter attached to a hinge side of the frame or a hinge side of the sash of the casement window, the first sash lifter comprising a mounting portion and a lifting portion selectively engagable with the mounting portion, the lifting portion having an end presenting a lifting ramp, the lifting portion being selectively vertically shiftable relative to the mounting portion; and a second sash lifter adapted to attach to the other of the :frame or the sash of the casement window, the second sash lifter having an end presenting a lifting ramp;

wherein when the casement window is shifted from the open position to the closed position, the ramp of the first sash lifter engages with the ramp of the second sash lifter causing the sash to shift vertically relative to the frame, and wherein the mounting portion of the first sash lifter includes an adjustment screw arranged to drive vertical shifting of a vertical position of the lifting portion.

* * * * *